United States Patent [19]

Rottler et al.

[11] Patent Number: 4,550,530

[45] Date of Patent: Nov. 5, 1985

[54] SHORT-STROKING HONING MACHINE

[75] Inventors: Donald Rottler, Seattle; David Engnell, Issaquah, both of Wash.

[73] Assignee: Rottler Manufacturing Co., Kent, Wash.

[21] Appl. No.: 503,279

[22] Filed: Jun. 10, 1983

[51] Int. Cl.[4] ..... B24B 5/08

[52] U.S. Cl. ..... 51/34 R

[58] Field of Search ..... 51/34 J, 165.93, 34 D, 51/34 H, 34 C, 34 R

[56] References Cited

U.S. PATENT DOCUMENTS

| | | | |
|---|---|---|---|
| 2,573,368 | 10/1951 | Seborg | 51/34 D |
| 4,189,871 | 2/1980 | Rottler et al. | 51/34 J |
| 4,423,567 | 1/1984 | Raven, III | 51/34 R |

*Primary Examiner*—Frederick R. Schmidt
*Assistant Examiner*—Robert Rose
*Attorney, Agent, or Firm*—Seed and Berry

[57] ABSTRACT

A honing machine includes a specially designed, pneumatic short-stroking circuit which may be actuated to oscillate a honing tool in the bottom of a bore to remove lower bore tapers with increased speed and efficiency.

2 Claims, 1 Drawing Figure

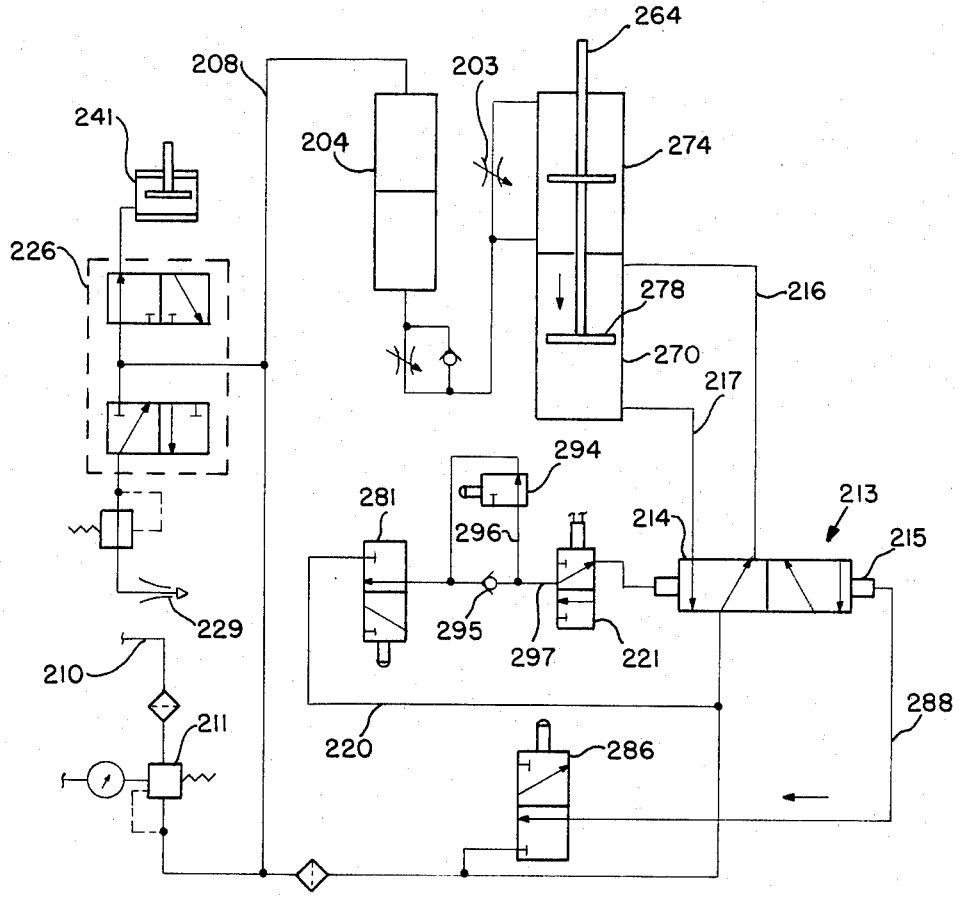
264
208
203
241
204
274
226
278
216
270
217
294
281
213
214
296
215
229
295
297
221
210
288
211
220
286

SHORT-STROKING HONING MACHINE

DESCRIPTION

TECHNICAL FIELD

The present invention relates to honing and abrading machines and the like, and more particularly, to a machine for effectively and efficiently removing tapers from the lower portion of a cylindrical bore.

BACKGROUND ART

Relatively inexpensive honing machines are currently used in small engine reconditioning shops for finishing rebored workpieces, such as engine blocks. A common type of honing machine used for such purposes is often referred to at a "beam stroker." A machine of this type is disclosed in U.S. Pat. No 4,189,871. In such machines, an expandable honing tool is suspended from a pivoted arm or "beam" which contains mechanism for rotating and expanding the tool. The beam is swung up and down or "stroked" to vertically reciprocate the rotating honing tool within the workpiece, thereby honing the inner surface of the rebored workpiece.

One problem often encountered in honing operations is lower bore taper. Ideally, the honing machine would be adjusted such that the honing tool extends out the lower end of the bore approximately ¾ inch at the bottom of the stroke. In many engine blocks, however, such extension is impossible because of a web member on the engine block which blocks passage of the honing tool. Consequently, the lower regions of a cylindrical bore will not be adequately honed by the normal stroking process and will require additional honing to remove excess material for a proper finish. Existing honing machines enable the machine operator to interrupt stroking of the honing tool at the bottom of the stroke so that the honing tool will dwell in the bottom of the bore, thereby removing the excess material which creates the lower bore taper.

Allowing the honing tool to dwell at the bottom of its stroke will remove lower bore tapers more effectively than normal stroking of the tool within the entire bore, but several disadvantages remain with existing dwelling procedures. First, removing excess material while the tool is held vertically stationary is a relatively slow procedure. Additionally, when the honing tool is rotated at a fixed elevation within the bore, vibration and chatter will result, tending to produce a bad finish. Also, when the tool is not stroking, the stones of the tool will tend to "load up" as the material removed during honing glazes over the stones, reducing their efficiency.

DISCLOSURE OF INVENTION

It is an object of this invention to provide a honing machine which will operate to automatically and efficiently eliminate lower bore tapers.

It is another object of this invention to provide a honing machine which will remove such lower bore tapers by providing a short-stroking capacity.

These and other objects, which will become more apparent at the invention is described more fully below, are obtained by providing a honing machine having a specially designed short-stroking circuit within the pneumatic control system of the machine. When the short-stroking circuit is actuated, pressurized air is trapped and used to shift a control valve to lower the honing tool to the bottom of its stroke as it attempts to move upwardly. The honing tool is thus caused to reciprocate into a number of short strokes near the bottom of the cylindrical bore.

BRIEF DESCRIPTION OF THE DRAWINGS

The drawing is a pneumatic schematic diagram of the stroking control system illustrating the short-stroking circuit of this invention.

BEST MODE FOR CARRYING OUT THE INVENTION

The preferred embodiment of this invention is a modification of the honing machine disclosed in U.S. Pat No. 4,189,872, to Rottler et al. As described herein, the machine disclosed in that patent has been modified by changing the pneumatic stroking control system to include a novel short-stroking circuit.

The pneumatic stroking control system utilized in a preferred embodiment is illustrated schematically in the drawing. The system basically operates by alternately supplying pressurized air from a primary air line 210 to either side of a piston 278 within an air cylinder 270. The piston is connected to a rod 264 for stroking of the honing tool, as described in U.S. Pat. No. 4,189,871. A control valve 213 operates to alternately pressurize and vent two air lines 217, 216 leading to the air cylinder for moving the rod up and down to stroke the honing tool. When the piston reaches the top of its stroke, it manually actuates an upper limit control valve 281 to allow pressurized air to pass from line 220 to an air pilot 214 of the control valve 213 to shift a spool within the control valve such that pressurized air will enter line 216 while line 217 remains vented, thus starting the piston on its downstroke. Similarly, when the piston reaches the bottom of its stroke, it will manually trigger lower limit control valve 286 to send pressurized air through line 288 and into a second air pilot 215, reshifting the spool to send pressurized air to line 217 to start the upstroke of the piston. A stop-stroking solenoid 221 can be enable by the machine operator to cut off the flow of pressurized air to the air pilot 214 such that the control valve will remain in the "up" position, thereby terminating stroking at the top of the stroke.

The short-stroking circuit is placed between the upper limit control valve 281 and the stop-stroking solenoid 221. When short-stroking near the bottom of the stroke is desired, the operator actuates a switch on a short-stroking dwell valve 294 to shift the valve from its normal open position into a closed position. When the dwell valve is closed, pressurized air from the upper limit valve (when it is open) must pass through a check valve 295 to activate the air pilot 214 to shift the control valve 213 into the "down" position. Note that after the air pilot is actuated, pressurized air will be trapped in lines 296, 297 by the check valve and closed dwell valve. The piston 278 will continue moving down until it actuates the lower limit valve 286. At this time, the air pressure in lines 296, 297 will be less than the pressure in line 288, as some air will escape through the check valve when it closes. The lower limit valve will pressurize line 288 to activate the air pilot 215 and shift the control valve into the "up" position. The piston will then begin to move upwardly, away from the lower limit valve, allowing the lower limit valve to close and exhaust the air in lne 288. Once the air is exhausted, the trapped air in lines 296, 297 will activate the air pilot 214, causing the piston to move downwardly until it hits the lower limit valve. When the piston reaches the bottom of its stroke, the lower limit valve will be actuated to begin the upstroke. As the piston moves upwardly, the lower limit valve will again close. The remaining trapped air in lines 296, 297 will again cause the piston to begin its downstroke. A series of "short strokes" in the bottom of the bore will thus continue until all the trapped air in lines 296, 297 has been exhausted.

The remaining parts of the control system are the same as those disclosed in U.S. Pat. No. 4,189,871. An oil cylinder 274 is positioned above the air cylinder 270 and regulates the speed of the rod 264 using a needle valve 203. The needle valve preferably can be closed completely to terminate stroking at any point along the stroke, if desired. An air-oil accumulator 204, pressurized by line 208, supplies oil to the cylinder. A selector 206 supplies air to the clamping cylinder 241 and to grooves 229 in the base of the unit to float it above the planar slide surface.

Although the invention has been described herein with regard to one particular embodiment, it is not intended that the invention be specifically limited to that embodiment. Additionally, the short-stroking circuit disclosed herein could be used with different honing machines than the one disclosed in U.S. Pat. No. 4,189,871. For example, the circuit can be employed with honing machines having automatic control units for performing a preset honing sequence, such as is disclosed in a co-pending application to Rottler el at, entitled "Automatic Control System for Honing Machine," assigned to the same assignee as the present application and filed on the same date. Many changes in the preferred embodiment will be obvious to those of ordinary skill in the art, and it is intended that the invention encompass all equivalent embodiments which are within the spirit of the invention.

We claim:

1. In a honing machine of the type having a honing tool, means for rotating the honing tool, and stroking means for vertically stroking the honing tool including a pneumatic system operative from a compressed air supply and including a double-acting piston in a cylinder having a piston rod with a variable stroke determining full stroking and short stroking of the honing tool, the improved pneumatic system comprising:

a control valve operatively connected to opposite ends of the cylinder and to the compressed air supply, and having a spool movable between a tool raising station whereat a first end of the cylinder is pressurized and the second end is vented, and a tool lowering station whereat said first end is vented and the second end is pressurized;

first and second air supply circuits to the control valve from the air supply;

a normally closed upper limit control valve in the first circuit caused to open when said piston rod is at a first limit of its travel corresponding to an upper stroke limit of the honing tool, and move the control valve from its tool raising station to its tool lowering station;

means in the second circuit for reducing the air pressure supplied by the second circuit to the control valve to a pressure less than the air pressure supplied by the first circuit to the control valve so that the spool will always move to the tool lowering station when the lower limit control valve is in closed position;

a normally open upper limit control valve in the second circuit caused to open when said piston rod is at a second limit of its travel corresponding to a lower stroke limit of the honing tool, and move the control valve from its tool lowering station to its tool raising station;

a normally short stroking dwell valve and a check valve in the second circuit and arranged in parallel relation to one another, the check valve preventing flow in the air supply direction;

the valves in the second circuit being arranged so that opening of the short stroking dwell valve isolates compressed air in the second circuit between the control valve and the check valve and short stroking dwell valve whereby each time the lower limit control valve opens and vents the portion of the second circuit between the control valve and the lower limit control valve, the spool in the control valve responsively moves toward its tool raising station by way of said isolated compressed air in the second circuit.

2. In a pneumatic system according to claim 1, a normally closed stop-stroking valve in the second circuit arranged to vent the second circuit so as to cause the spool of the control valve to be blocked from compressed air biasing the spool toward the tool lowering station.

* * * * *